US005355808A

United States Patent [19]

Early

[11] Patent Number: 5,355,808

[45] Date of Patent: Oct. 18, 1994

[54] BATTENLESS RAILCAR HATCH COVER ASSEMBLY

[75] Inventor: Stephen R. Early, Olathe, Kans.

[73] Assignee: Aero Transportation Products, Independence, Mo.

[21] Appl. No.: 948,116

[22] Filed: Sep. 21, 1992

[51] Int. Cl.[5] ..... B61D 39/00

[52] U.S. Cl. ..... 105/377 R

[58] Field of Search ..... 105/377; 296/100; 292/307 R

[56] References Cited

U.S. PATENT DOCUMENTS

| | | | |
|---|---|---|---|
| 886,472 | 5/1908 | Brown | 105/377 |
| 1,227,408 | 5/1917 | Ewing | 105/377 |
| 3,664,270 | 5/1972 | Stark et al. | 105/377 |

*Primary Examiner*—Mark T. Le

*Attorney, Agent, or Firm*—Kokjer, Kircher, Bowman & Johnson

[57] ABSTRACT

A battenless hatch cover assembly for railcars. The assembly includes a series of hatch covers aligned end to end to cover an opening in a railcar. Each of the hatch covers is hinged along one side to the railcar, with this one side being common among the hatch covers. In an alternative embodiment, appropriate mechanisms could be used to selectively hinge the covers along both sides. The typical cover includes one longitudinal end having a male portion in the form of an upstanding lateral lip. The other longitudinal end is provided with a female portion in the form of a laterally extending downward directed channel. This female portion is adapted to overlie the male portions in a substantially mating configuration. A seal material is provided on the underside of the female portion to engage the male portion and provide an effective seal, and the female portion is sufficiently rugged to apply a sealing pressure upon the male portion. The hatch covers are arranged such that the female portion of the hatch covers overlies the male portion of an adjacent hatch cover. This arrangement eliminates the need for separate or independent battens to apply a seal between the hatch covers.

15 Claims, 3 Drawing Sheets

BATTENLESS RAILCAR HATCH COVER ASSEMBLY

BACKGROUND OF THE INVENTION

1. Field of the Invention

The present invention relates in general to hatch covers for railcars. In particular, the present invention relates to an improved hatch cover assembly for railcars which eliminates the need for battens.

2. Description of the Related Art

Railcars have long been employed to transport granular material such as grain. Such railcars typically have a series of openings, or a single opening, in the top of the railcar through which the grain may be loaded, with the openings commonly being referred to as troughs. Associated with these openings are one or more hatch covers which close and seal the openings during transport.

The hatch covers are typically provided in sets of three or more, even where a single elongated opening is employed. The hatch covers are hinged along one edge, with the hinges for the hatch covers being substantially coaxial. The edges of adjacent hatch covers are in close proximity, and a series of battens are supplied to overly and provide a seal between these edges, and at the outermost ends. As such, a railcar having four covers would employ five battens.

While this arrangement has been found serviceable it does have associated problems. For example, it is necessary to release and pivot the battens away from the hatch covers in a separate operation prior to opening the hatch cover. Additionally, the pivot of the batten is subject to wear such that metal portions of the batten tend to contact the hatch cover. The battens are typically formed of steel, while the hatch covers are normally formed of aluminum or fiberglass. As such, the battens tend to damage the hatch cover in time, due to this wear.

SUMMARY OF THE INVENTION

An object of the present invention is to provide a hatch cover assembly for a railcar which may be easily and quickly moved from a closed to a open position, and vice versa.

Another object of the present invention is to provide a railcar hatch cover which may pivot about either lateral edge to an open position.

Another object of the present invention is to provide a railcar hatch cover assembly having modular components.

Another object of the present invention is to provide a railcar hatch cover assembly which provides an effective seal without the use of independent battens.

These and other objects are achieved by a battenless hatch cover assembly for railcars. The assembly includes a series of hatch covers aligned end to end to cover an opening in a railcar. Each of the hatch covers is hinged along one side to the railcar, with this one side being common among the hatch covers. In an alternative embodiment, appropriate mechanisms could be used to selectively hinge the covers along both sides. The typical cover includes one longitudinal end having a male portion in the form of an upstanding lateral lip. The other longitudinal end is provided with a female portion in the form of a laterally extending downward directed channel. This female portion is adapted to overlie the male portions in a substantially mating configuration. A seal material is provided on the underside of the female portion to engage the male portion and provide an effective seal, and the female portion is sufficiently rugged to apply a sealing pressure upon the male portion. The hatch covers are arranged such that the female portion of the hatch covers overlies the male portion of an adjacent hatch cover. This arrangement eliminates the need for separate or independent battens to apply a seal between the hatch covers.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figures 1, 2:
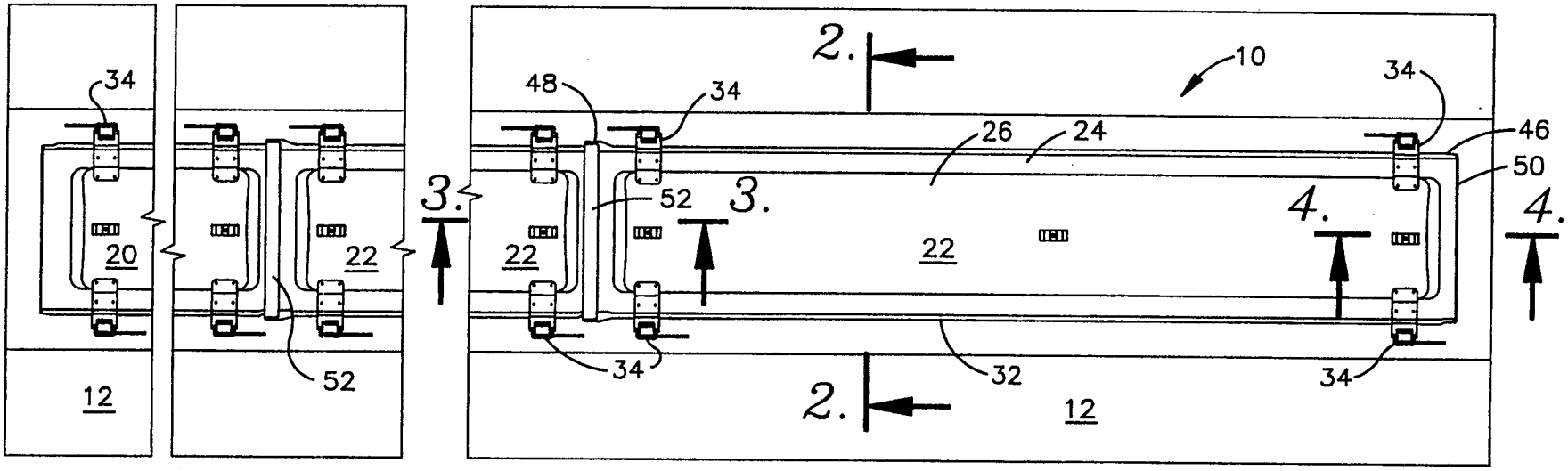
FIG. 1 is a plan view showing a hatch cover assembly according to the present invention.
FIG. 2 is a cross-sectional view taken along line 2—2 of FIG. 1.

With reference to FIG. 1, a railcar hatch assembly according to the present invention is generally designated by reference numeral 10. The hatch assembly is mounted upon the upper surface or roof sheet of a railcar 12 which includes at least one trough or opening 14 extending therethrough. The opening 14 provides access to the interior to the railcar such that granular material, such as grain, may be loaded and unloaded from the railcar.

The opening or openings 14 are substantially rectangular and elongated in the direction of travel of the railcar (hereafter the longitudinal direction). The periphery of the or each opening includes an upward extending trough coaming or sidewall 16 which provides a sealing surface at its upper end. This sealing surface may advantageously be formed by the upper surface of an arcuate portion 18. If a plurality of the openings 14 are provided, these openings are aligned with their longitudinal axes substantially coincident, and with their longitudinal ends in close proximity.

The hatch cover assembly 10 according a first embodiment of the present invention includes a single end cover 20 (the leftmost cover of FIG. 1) and one or more modular covers 22. While the end cover and modular covers are of a different design for a purpose made clear below, there are a large number of common features between both covers. As such, the similarities between the cover 20 and covers 22 will be first discussed.

Each of the covers may have a generally rectangular configuration elongated in the longitudinal direction.

As with the openings 14, in the assembled and closed condition shown in FIG. 1, the covers will be arranged with their longitudinal axes substantially coincident and be arranged in a longitudinally extending line with the longitudinal ends of adjacent covers overlapping. While the covers may be of different lengths, it is preferred that they be substantially uniform for easy replacement.

Figure 3:
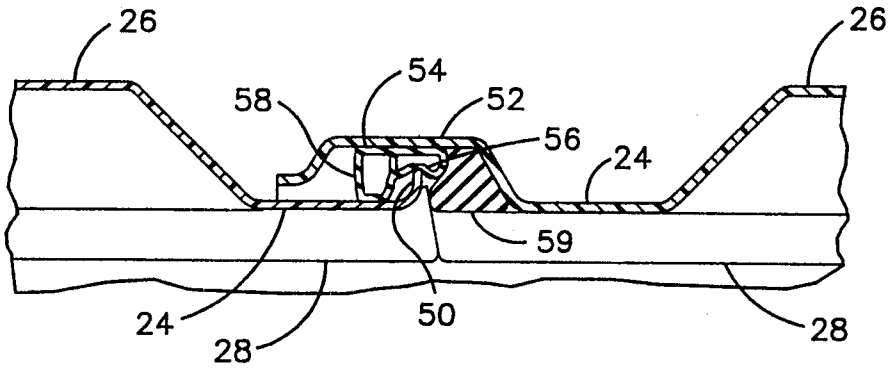
FIG. 3 is a cross-sectional view taken along line 3—3 of FIG. 1.
Figure 4:
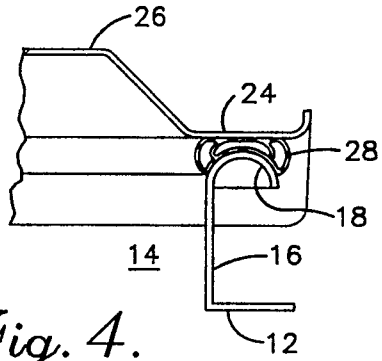
FIG. 4 is a cross-sectional view taken along line 4—4 of FIG. 1.

Each of the covers 20 and 22 will have a substantially planar edge portion 24 extending about the periphery of the cover. While the interior portion of each cover could continue with this planar configuration, it is preferred that each cover include a central portion 26 which is raised upward with respect to edge portion 24, and includes transition sections therebetween, to provide the cover with increased stiffness. As is best shown in FIGS. 2–4, the edge portion and central portion preferably have a substantially constant thickness.

Figure 3B:
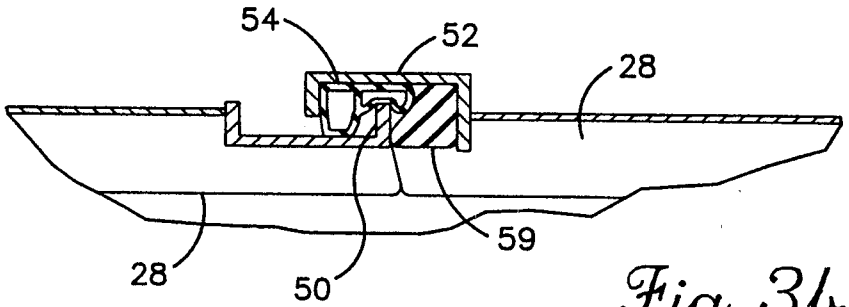
FIG. 3*b* is a cross-sectional view of a further alternative configuration taken along line 3—3 of FIG. 1.
Figure 3A:
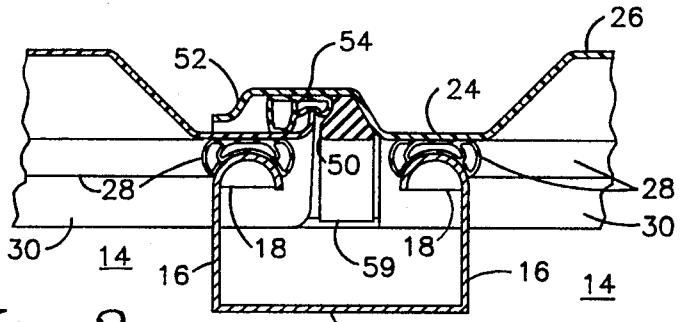
FIG. 3*a* is a cross-sectional view of an alternative configuration taken along line 3—3 of FIG. 1.

The covers are sized such that the edge portions 24 are located above the upper end of the sidewalls 16 of the openings, and in particular above the arcuate portion 18, at least at the lateral sides of the covers. In particular, where two or more covers are associated with a single opening certain ones of the longitudinal ends of the covers will extend laterally across the opening 14. Since by definition there is no sidewall extending laterally across the opening between its longitudinal ends, the edge portions 24 at those certain longitudinal ends will not be located above a sidewall. This situation is illustrated in FIG. 3. At the longitudinal ends of the opening, however, the edge portions 24 are located above the laterally extending sections of the sidewall, as illustrated in FIGS. 3*a* and 4.

To eliminate or reduce the ingress of moisture or other contaminants into the railcar, appropriate seals 28 are located on the lower face of the edge portion such that the seals will contact and conform to the arcuate portions 18. As is well known in the art, seals 28 are preferably formed of a rubber or plastic which is resilient to conform to the arcuate portion and thus provide an improved seal. As is best shown by comparison of FIGS. 3 and 3*a*, the seals 28 are preferably located only on those edge portions 24 which are located above a sidewall 16, and as such do no extend laterally in FIG. 3.

To further reduce the possibility of ingress of contaminants, the lateral sides of each cover include a lateral sidewall 30 which extends downward from the outer edge of edge portion 24. For yet further protection and increased strength, a side flange or lateral lip 32 may extend laterally outward from the lower end of each lateral sidewall 30.

The connections of the covers 20 and 22 to the railcar may be made along these lateral edges. In particular, a plurality of hinge brackets may be fixed to the upper surface of the railcar 12 adjacent a first lateral side of the opening or openings 14. Each of the hinge brackets would includes an opening which defines the pivot axis for the associated cover. This pivot axis is substantially parallel to the longitudinal axis of the covers, and would preferably be spaced laterally outward from the furthest lateral extent of the first lateral side of the associated cover, which in this particular configuration would be the outer edge of lateral lip 32.

The covers 20 and 22 would then include hinge members fixed thereto at locations substantially corresponding to the hinge brackets, with each of the hinge members including an opening at its outer lateral end substantially coaxial with the opening in the hinge bracket. A hinge bolt could then extend through both of these openings at each of the hinge brackets such that the hinge member, and thus the associated cover, would be rotatably mounted to the hinge bracket, and thus the railcar.

With such an arrangement the second lateral side of each cover 20 and 22 would include latch means to fix the cover in the closed and sealed position shown in FIG. 1. In particular, one or more latch mounting brackets would be fixed to the upper surface of the railcar 12 at positions along the second lateral edge of the openings 14. As with the hinge brackets, the latch mounting brackets would preferably be located laterally outside of the furthest lateral extent of the associated cover. A latch mechanism of conventional design could then be fixed to each cover at a location corresponding to each of the latch mounting brackets, such that the latch mechanism will be in close proximity to the latch mounting bracket when in the closed configuration to releasable engage the latch mounting bracket. Such a latch mechanism may be of any type known in the art, and may take the form of the latch shown in U.S. Pat. No. 4,635,979 to Blume, which is included herein by reference.

While the above hinge and latch arrangement is serviceable in that it will allow the covers to be pivoted open and closed and to be locked in the closed position, it is preferred to provide the covers with a dual hinge ability. Specifically, it is preferred to provide at least one, and preferably two or more, combination hinge and lock assemblies 34 along each lateral edge of each cover, with the hinge axes of the assemblies 34 for each lateral side being substantially coaxial. Such hinge and lock assemblies are of the type which may be placed in a locked condition in which the assembly acts as a hinge, or may be manually unlocked to allow portions of the assemblies to be separated. As such, by employing such assemblies on both lateral sides of a cover, the cover may be securely locked in the closed position, or may be pivoted about either lateral side to the open position simply be releasing the assemblies on the opposite lateral side. A preferred assembly for this arrangement is sold under the mark AZEE by IRECO.

From the above description it should be apparent to those skilled in the art that each of the covers 20 and 22 may be pivoted about a pivot axis substantially parallel to the longitudinal direction of the openings 14 to move the cover into and out of covering relation to the opening. When the cover is lying over the opening 14, the latch mechanism or assembly 34 may be engaged to securely retain the cover in the closed position, and to apply a downward pressure to the cover such that the seals 28 will be compressed against the sidewall 16 of the opening.

While the above description lists the features which are common between the covers 20 and 22, the differences between the cover 22 and cover or covers 22 shown in FIG. 1 will now be described. Specifically, each of the covers 20 and 22 includes a first and a second longitudinal end, with these ends being oriented similarly for each of the covers. In other words, where the railcar upper surface 12 includes a first and a second longitudinal end, for each of the covers the distance between the first longitudinal end of the railcar and the first longitudinal end of the cover will be less than the distance between the first longitudinal end of the railcar and the second longitudinal end of the cover. As such, for adjacent ones of the covers the first and second longitudinal ends of the respective covers will be in proximity. By way of convention, the right hand end of each cover (with respect to FIG. 1) will be designated a first end 46, while the opposite end will be designated second end 48.

As shown in FIG. 1, first end 46 of each cover 20 and 22 has a lateral extent substantially corresponding to, or slightly smaller than, that of the lateral sidewalls 30. With reference to FIG. 4, these first longitudinal ends per se may include an upwardly directed sealing lip 50, as is known in the art. The second longitudinal end 48 of each of the modular covers 22 has a vertical and lateral extent slightly greater than that of the lateral sidewall 30, or at least greater than that of the first end 46, such that the second longitudinal end of any cover may partially wrap around or over the first longitudinal end of an adjacent cover. As is best shown in FIG. 3, the second end 48 includes a longitudinally extending compression lip 52 which is spaced vertically above the upper edge of sealing lip 50. Additionally, while the first and second ends 46 and 48 of adjacent covers are provided with a small spacing therebetween, the longitudinal extent of the compression lip 52 is such that it extends a distance beyond the sealing lip 50 of the adjacent cover.

Fixed to the bottom face of the compression lip 52 is a compression seal 54. The compression seal is formed of a resilient material similar to that of seal 28, and extends along the entire lateral length of the compression lip 52. The compression seal 54 includes a first portion 56 positioned to be located directly above the sealing lip 50 of the adjacent cover. The seal 54 also includes a second portion 58, spaced further from the first end of the associated cover than the spacing of the first portion 56 from such first end, and which has a greater vertical extent.

As is best shown is FIG. 3, when the covers are in the closed position the compression seal 54 of each of the modular covers 22 will be placed in sealing compression against the adjacent cover. In particular, the first portion 56 of the seal will compress against the sealing lip 50, while the second portion 58 will compress against the edge portion 24 just inward of such sealing lip 50. With this arrangement it may be seen that the first and second portions of the compression seal provide two separate seals against the ingress of moisture and contaminants.

To provide further seal security, a filler gasket 59 may be fixed to the compression lip 52 inward of the first portion 56 and having a length corresponding to that of seal 54. The filler gasket will abut against the longitudinally interior edge of the first portion 56 to improve the seal of this first portion against the sealing lip 50. Where the adjacent covers are associated with different openings, as in FIG. 3*a*, the filler gasket serves no other purpose. However, where the covers are used on a common opening, as in FIG. 3, the filler gasket provides additional sealing. In particular, the lateral ends of the filler gasket contact the seal 28 extending along the lateral sides of the cover, and a lower longitudinally outer portion of the filler gasket may contact a portion of the seal 28 of the adjacent cover, thus assisting in the sealing of the lateral ends of the overlapping covers.

In addition to providing an excellent seal, an important aspect of the present invention is the ability of the compression lip 52 and compression seal 54 to provide a downward force against the adjacent cover. In particular, the force generated by the hinge elements or assemblies 34 acting upon the right hand cover of FIG. 3 will be transmitted through the compression lid 52 and compression seal 54 to provide a downward force upon the first end of the left hand cover of FIG. 3. This force will be in addition to the force generated by the hinge or assemblies 34 of such left hand cover. This provides additional security in keeping the covers in the closed position.

This arrangement of the compression lip 52 resting upon the sealing lip 50 is common for each of the second and first ends of adjacent covers. However, the second end 48 of the end cover 20 is not adjacent to any other covers. As such, the second end 48 of end cover 20 need not be formed with a compression lip 52. The end cover 20 may therefore be formed with a second end 48 which has a configuration substantially corresponding to that of the first end 46 of the covers. As such, each of the modular covers 22 may be asymmetrical in that the first and second ends 46 and 48 are formed with different structures, but the end cover 20 may be symmetrical about a lateral axis, with the first and second ends being substantially identical.

Alternatively, the end cover 20 may take a form similar to that of the modular covers 22. Where the end cover 20 includes a compression lip 52 similar to the modular covers 22, the laterally extending seal 28 will still be in compression contact with the sidewall 16 of the railcar as in the embodiment shown in FIG. 1, but the compression lip 52 will extend outwardly from second end 48. As should be apparent, the compression lip 52 of the end cover 20 will not engage an adjacent cover and will merely extend outwardly, serving no purpose. While the symmetric end cover 20 shown in FIG. 1 is preferred due to the reduced materials necessary to form such an end cover, the alternative embodiment with the end cover 20 including a compression lip 52 and seal 54 has the advantage of being modular, such that it may be readily replaced or used to replace one of the modular covers 22. It is also possible to initially form the end cover 20 as a symmetric member as shown in FIG. 1, yet replace it with a cover having the compression lip 52 in the event of damage.

In each of the figures discussed above, the covers have been shown with configurations and smooth transitions commonly associated with fiberglass constructions, which is a common material for the formation of the covers. However, it is also known to form the covers of aluminum. The present invention is of course not limited to any specific materials, and to this end a modification of the invention for the use of aluminum covers is shown in FIG. 3*b*. This modification is similar to the cover arrangement shown in FIG. 3, except that the overlapping portions of the covers may advantageously be formed by extruded channels welded to the main panels. It should be apparent to those in the art that the arrangement of FIG. 3*a* could of course be formed using aluminum as in FIG. 4.

Figure 7:
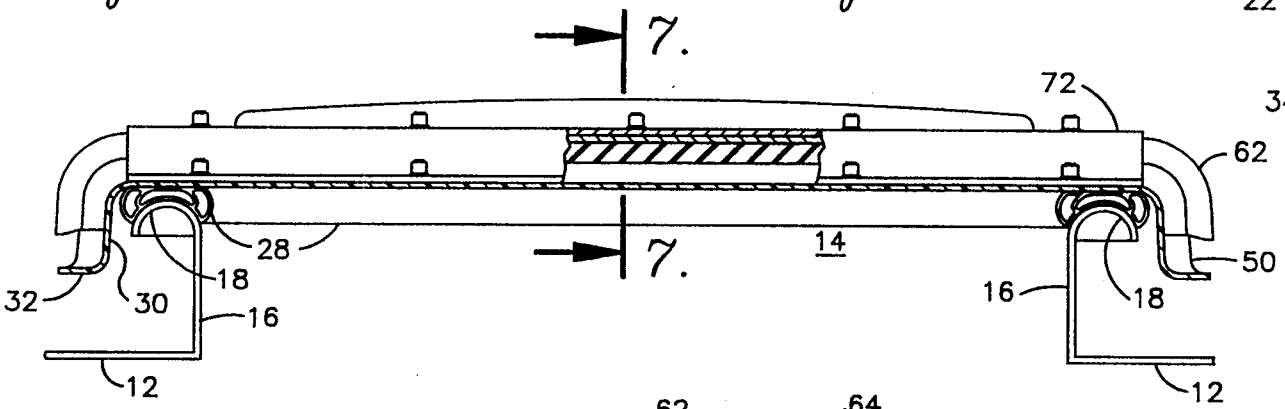
FIG. 7 is a cross-sectional view taken along line 7—7 of FIG. 6.

While in the arrangements described above the compression lip 52 is an original factory construction with the remainder of the lid, it is possible to modify existing hatch assemblies which include prior art battens to a battenless configuration equivalent to that shown in FIGS. 1–4. This modified arrangement is shown in FIGS. 5–7.

Figure 5:
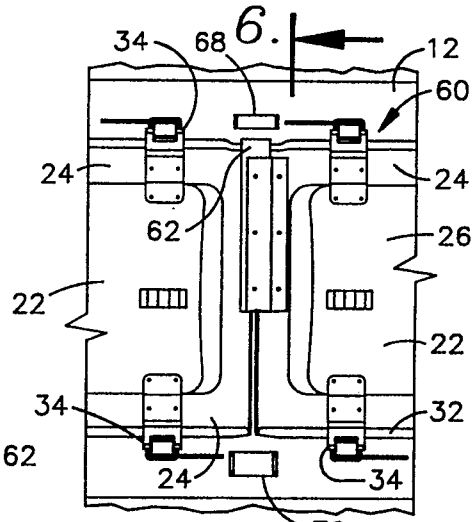
FIG. 5 is a detail plan view showing a second embodiment according to the present invention.
Figure 6:
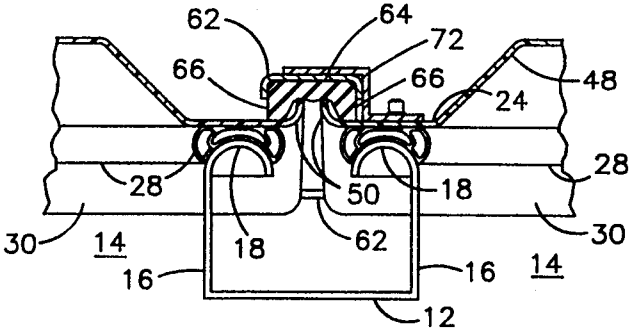
FIG. 6 is a cross-sectional view along line 6—6 of FIG. 5.

With reference to FIG. 5, a modified hatch assembly according to the present invention is generally designated by reference numeral 60. The elements of the prior art hatch assembly which have not been modified, and which are identified by reference numeral similar to those in the first embodiment, are the covers 22, each having an edge portion 24, central portion 26, seal 28, sidewall 30, lateral lip 32 and hinge elements or assemblies 34.

Such a prior art hatch assembly would additionally include a batten including a batten bar 62 and a batten seal 64. As is best shown in FIGS. 6 and 7, the batten bar 62 is elongated in nature and extends laterally across the covers 22. Bar 62 has a channel shaped configuration opening downward, with the batten seal 64 being received within such channels. The batten seal has an elongated shape corresponding to the batten bar 64 and includes edge extensions 66 which project downward and define a reduced thickness central portion. This reduced thickness central portion receives the sealing lip 50 of adjacent covers 22, while the extensions 66 rest against the edge portion 24 of respective adjacent covers. This defines a seal arrangement similar to that of compression seal 54, yet acting upon two adjacent sealing lips 50.

In the prior art arrangement such a batten bar and batten seal would be pivotally connected to a batten hinge bracket 68 at one lateral side, and be releasable retained by a batten latch assembly mounted upon a batten latch bracket 70. The compressive forces generated by the hinged and latched batten would transmit a compressive force to the adjacent longitudinal ends of the covers 22. However, in the present modification the batten bar 62 is not physically connected to the hinge bracket 68 or latch bracket 70.

Instead, the batten bar is rigidly connected to one of the adjacent covers 22, and in particular is connected to the second longitudinal end 48 of each of the Covers 22. This rigid mounting is effected by a Z-bracket 72 having a first leg rigidly fixed to the edge portion 24 at the second end 48 of the cover 22, an intermediate portion extending vertically upward to a position spaced above the upper most end of the sealing lip 50, and a second leg extending outwardly beyond the associated cover 22, and possibly longitudinally inward of the adjacent cover 22. The batten bar 62 is fixed to the underside of this second leg such that it is generally centered over the adjacent sealing lips 50. As may be readily envisioned, this arrangement is substantially equivalent to that of the embodiment shown in FIGS. 1–4.

To provide the compressive forces upon the right hand cover of FIG. 7 such that they may be transmitted through the batten bar and batten seal to the left hand cover of FIG. 7, each of the covers are provided with hinge elements or assemblies 34, which may be identical to those employed in the first embodiment, with the placement of such elements also being substantially identical. While this modified arrangement is shown using the original seal 64, it is possible to replace this seal with a seal an gasket arrangement as in FIG. 3.

As should be apparent to those skilled in the art, the present invention, as exemplified by any embodiment described, will provide excellent compressive and sealing forces upon the various covers of the hatch assembly. Additionally, as the compression lips or fixed batten bars are stationary with respect to each adjacent cover, there is no possibility that such compression lip or batten bar will strike, and thus damage, an adjacent cover. As such, the present invention avoids the damage associated with prior art hatch assemblies. Furthermore, the covers according to the present invention may be substantially modular in nature, such that they may be readily mass produced and easily replaced. While it is preferred that the covers be formed of fiberglass laminates, aluminum or other materials could be employed.

In operation, it is of course necessary to open the covers according to the present invention in a specific order. With particular reference to FIG. 1, the cover closest to the first end of the railcar, which is the only cover which is not compressed by the compression lip of an adjacent cover, must be opened prior to opening of the other covers. Similarly, the next cover closest to this first end of the railcar must be opened next for similar reasons. In general, the covers must be opened sequentially from the first end of the railcar to the second end. While this arrangement does provide limitations on the opening of the covers, it does eliminate the need to unlatch and open the separate battens of the prior art.

Figure 8:
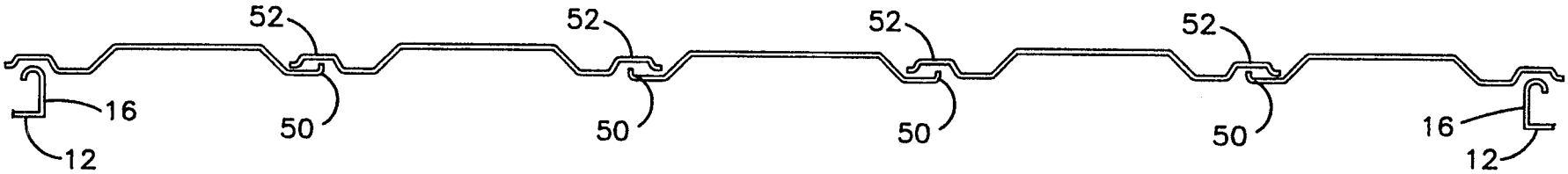
FIG. 8 is a schematic depiction of an alternative hatch arrangement according to the present invention.

While the compression lips 52 must clearly overly the sealing lips 50, the arrangement described immediately above is of course not the only arrangement to meet this requirement. For example, FIG. 8 schematically shows an alternative hatch arrangement employing compression and sealing lips where all of the covers are symmetrical (i.e. each individual cover has similar longitudinal ends). Other arrangement are of course possible, with the only requirement being the adjacent ends of the covers provide one sealing lip and one compression lip.

As this is required, it follows that the cover having the compression lip will always be closed last between adjacent covers. This fact may be used to improve the sealing of the covers. In particular, as is shown in FIGS. 3 and **3*b*, where the adjacent covers are associated with a common opening, the longitudinal ends of the seals 28 may be modified such that the seal associated with the cover having the compression lip will overly the seal associated with the other cover. The seal of the cover having the sealing lip may be enlarged at its upper edge to have a greater vertical height and ensure contact with the outer lower edge of the filler gasket 59. Additionally, the lower edge of this same seal is extended longitudinally outward, with the seal of the cover having the compression lip having its lower edge withdrawn by a similar amount, such that the ends of the seals form complimentary angles with vertical and the angle associated with the compression lip is greater than ninety degrees. This will allow that seal 28** to slightly overly the other seal, allowing much better compression and sealing than if the seals ended in vertical faces.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A hatch assembly for rail cars having at least one opening therein extending in a longitudinal direction, such opening having first and second ends, comprising:

a plurality of covers, each having lateral sides and longitudinal ends, said covers being arranged in a longitudinal series along the longitudinal direction with adjacent ones of said covers each having an associated one of said longitudinal ends in proximity to each other in a closed position to therefore define at lest one set of adjacent longitudinal ends, a first of said longitudinal ends of each said set having a compression lip extending longitudinally outwardly therefrom, and thus extending longitudinally inward of, and spaced above, a second of said longitudinal ends of each said set, when in said closed position, a second of said longitudinal ends of each said set having a sealing lip extending upward therefrom;

a compression seal fixed to a bottom face of each of said compression lips and adapted to abut against said second of said longitudinal ends of said set when in said closed position, each said compression seal each including a first portion adapted to abut against said sealing lip and a second portion adapted to abut against an edge portion of said associated adjacent cover, said second portion extending downward a grater distance than said first portion;

means selectively permitting pivoting of each of said covers from a closed position in overlying relation to said opening to an open position providing access to said opening, said pivoting being about and axis substantially parallel to said longitudinal direction; and means for selectively locking each of said covers in said closed position, said means including a first portion mounted upon said cover and a second portion mounted upon said rail car, said portions interacting to selectively lock together, said means providing an entire force to secure each said cover in the closed position, with there being no batten bars extending laterally across any of said covers.

2. A hatch assembly as in claim 1, wherein said compression lips are formed as a monolithic portion of the associated ones of said covers.

3. A hatch assembly as in claim 1, further including:

a filler gasket fixed to said bottom face of each said compression lip longitudinally inward of, and adapted to abut at least against, said compression seal.

4. A hatch assembly as in claim 1, wherein each of said covers includes a seal fixed to a bottom surface thereof and extending about at least a portion of the periphery thereof and adapted to engage against the rail car and thus seal said opening.

5. A hatch assembly as in claim 4, wherein said compression lips are formed as a monolithic portion of the associated ones of said covers.

6. A hatch assembly as in claim 4, wherein said pivoting means comprises at least one combination hinge and lock assembly on each lateral side of each of said covers.

7. A hatch assembly as in claim 6, wherein said compression lips are formed as a monolithic portion of the associated ones of said covers.

8. A hatch assembly for rail cars having at least one opening therein extending in a longitudinal direction, such opening having first and second ends, comprising:

a plurality of covers, each having lateral sides and longitudinal ends, said covers being arranged in a longitudinal series along the longitudinal direction with adjacent ones of said covers each having an associated one of said longitudinal ends in proximity to each other in a closed position to therefore define at least one set of adjacent longitudinal ends, a first of said longitudinal ends of each said set having a compression lip extending longitudinally outwardly therefrom, and thus extending longitudinally inward of, and spaced above, a second of said longitudinal ends of each said set, when in said closed position, each said second end of said set including a sealing lip extending upward therefrom:

a compression seal fixed to a bottom face of each said compression lip and adapted to abut at least against an associated said sealing lip on said second of said longitudinal ends of said set when in said closed position;

a filler gasket fixed to said bottom face of each said compression lip longitudinally inward of, and adapted to abut at least against, said compression seal; and means selectively permitting pivoting of each of said covers from a closed position in overlying relation to said opening to an open position providing access to said opening, said pivoting being about and axis substantially parallel to said longitudinal direction.

9. A hatch assembly as in claim 8, wherein each said compression lip is formed as a monolithic portion of an associated one of said covers.

10. A hatch assembly as in claim 8, wherein said compression seals each includes a first portion adapted to abut against said sealing lip and a second portion adapted to abut against an edge portion of said associated adjacent cover, said second portion extending downward a greater distance than said first portion.

11. A hatch assembly as in claim 10, wherein each said compression lip is formed as a monolithic portion of an associated one of said covers.

12. A hatch assembly as in claim 10, wherein each of said covers includes a bottom seal fixed to a bottom surface thereof and extending about at least a portion of the periphery thereof and adapted to engage against the rail car and thus seal bottom seal of the associated and adjacent ones of said covers.

13. A hatch assembly as in claim 12, wherein each said compression lip is formed as a monolithic portion of an associated one of said covers.

14. A hatch assembly as in claim 12, wherein said pivoting means comprises at least one combination hinge and lock assembly on each lateral side of each of said covers.

15. A hatch assembly as in claim 14, wherein each said compression lip is formed as a monolithic portion of an associated one of said covers.

* * * * *

US005355808B1

REEXAMINATION CERTIFICATE (3149th)

United States Patent [19] [11] B1 5,355,808

Early [45] Certificate Issued Mar. 4, 1997

[54] BATTENLESS RAILCAR HATCH COVER ASSEMBLY

[75] Inventor: Stephen R. Early, Olathe, Kans.

[73] Assignee: Aero Transportation Products, Independence, Mo.

Reexamination Request:
No. 90/003,906, Jul. 18, 1995

Reexamination Certificate for:

| | |
|---|---|
| Patent No.: | **5,355,808** |
| Issued: | **Oct. 18, 1994** |
| Appl. No.: | **948,116** |
| Filed: | **Sep. 21, 1992** |

[51] Int. Cl.[6] ..... B61D 39/00
[52] U.S. Cl. ..... 105/377.01; 105/377.05
[58] Field of Search ..... 105/377.05, 377.01

[56] References Cited

U.S. PATENT DOCUMENTS

| | | | |
|---|---|---|---|
| 3,583,334 | 6/1971 | Schuller | 105/377.05 |
| 3,664,270 | 5/1972 | Stark et al. | 105/377 |
| 4,602,569 | 7/1986 | Kleykamp | 105/377 |

*Primary Examiner*—Mark T. Le

[57] ABSTRACT

A battenless hatch cover assembly for railcars. The assembly includes a series of hatch covers aligned end to end to cover an opening in a railcar. Each of the hatch covers is hinged along one side to the railcar, with this one side being common among the hatch covers. In an alternative embodiment, appropriate mechanisms could be used to selectively hinge the covers along both sides. The typical cover includes one longitudinal end having a male portion in the form of an upstanding lateral lip. The other longitudinal end is provided with a female portion in the form of a laterally extending downward directed channel. This female portion is adapted to overlie the male portions in a substantially mating configuration. A seal material is provided on the underside of the female portion to engage the male portion and provide an effective seal, and the female portion is sufficiently rugged to apply a sealing pressure upon the male portion. The hatch covers are arranged such that the female portion of the hatch covers overlies the male portion of an adjacent hatch cover. This arrangement eliminates the need for separate or independent battens to apply a seal between the hatch covers.

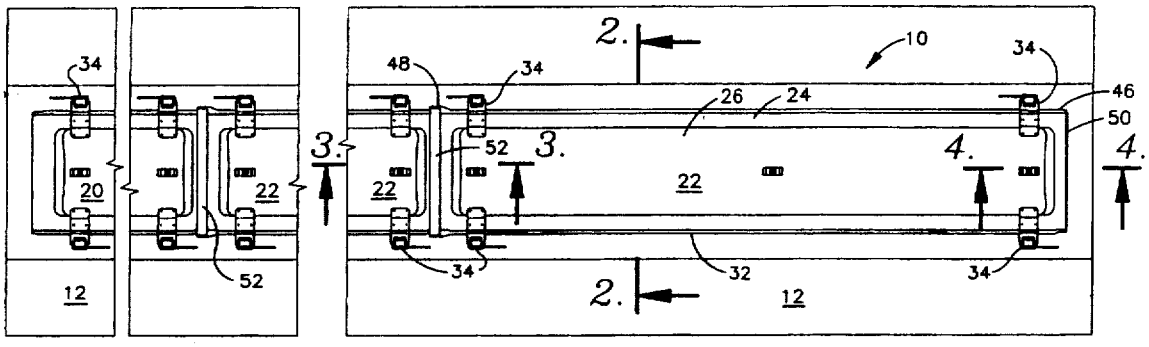

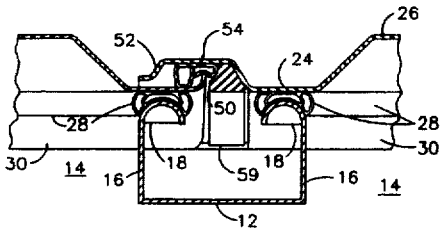

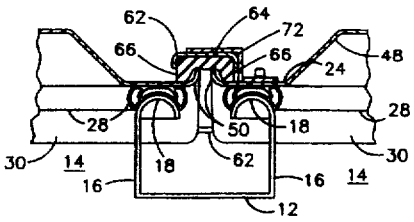

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–15 is confirmed.

New claim 16 is added and determined to be patentable.

*16. A hatch assembly for rail cars having at least one opening therein extending in a longitudinal direction, such opening having first and second ends, comprising:*

*a plurality of covers, each having lateral sides and longitudinal ends, said covers being arranged in a longitudinal series along the longitudinal direction with adjacent ones of said covers each having an associated one of said longitudinal ends in proximity to each other in a closed position to therefore define at least one set of adjacent longitudinal ends, a first of said longitudinal ends of each said set having a compression lip extending longitudinally outwardly therefrom, and thus extending longitudinally inward of, and spaced above, a second of said longitudinal ends of each said set, when in said closed position, a second of said longitudinal ends of each said set having a sealing lip extending upward therefrom;*

*a compression seal fixed to a bottom face of each of said compression lips and adapted to abut against said second of said longitudinal ends of said set when in said closed position, each said compression seal each including a first portion adapted to abut against said sealing lip and a second portion adapted to abut against an edge portion of said associated adjacent cover, said second portion extending from said bottom face a greater distance than said first portion when said covers are in an open position providing access to said opening;*

*means selectively permitting pivoting of each of said covers from a closed position in overlying relation to said opening to an open position providing access to said opening, said pivoting being about and axis substantially parallel to said longitudinal direction; and*

*means for selectively locking each of said covers in said closed position, said means including a first portion mounted upon said cover and a second portion mounted upon said rail car, said portions interacting to selectively lock together, said means providing an entire force to secure each said cover in the closed position, with there being no batten bars extending laterally across any of said covers.*

* * * * *